US005797780A

United States Patent [19]

Peng

[11] Patent Number: 5,797,780

[45] Date of Patent: Aug. 25, 1998

[54] HYBRID TUBELESS SEALING PROCESS FOR FLAT PANEL DISPLAYS

[75] Inventor: Chao-Chi Peng, Chinchu, Taiwan

[73] Assignee: Industrial Technology Research Institute, Hsin-Chu, Taiwan

[21] Appl. No.: 606,123

[22] Filed: Feb. 23, 1996

[51] Int. Cl.[6] ..... H01J 9/40

[52] U.S. Cl. ..... 445/25; 445/43; 445/70

[58] Field of Search ..... 445/25, 43, 70, 445/73

[56] References Cited

U.S. PATENT DOCUMENTS 4,071,058 1/1978 Albertin et al. ..... 141/65
5,349,217 9/1994 Boysel ..... 257/266

FOREIGN PATENT DOCUMENTS 160024 6/1992 Japan ..... 445/25
314906 11/1993 Japan ..... 445/25

OTHER PUBLICATIONS

Holloway et al "Production and Control of Vacuum . . . "; Solid Waste Technology.

Meyer et al "Recent Development on Microtips Display at LETI" Technical Digest of International Vacuum Microelectronics Conference Nagahama, Japan 1991, pp. 6–9.

*Primary Examiner*—Kenneth J. Ramsey
*Attorney, Agent, or Firm*—George O. Saile; Stephen B. Ackerman

[57] ABSTRACT

A hybrid tubeless process has been developed for creating a high vacuum spool-shaped glass frits plug to be used for low cost, high throughput manufacturing of flat panel display devices. This is accomplished by using a 3-port exhaust tube which allows high vacuum sealing of the FED with minimum contamination hence protects the device from early failure.

35 Claims, 3 Drawing Sheets

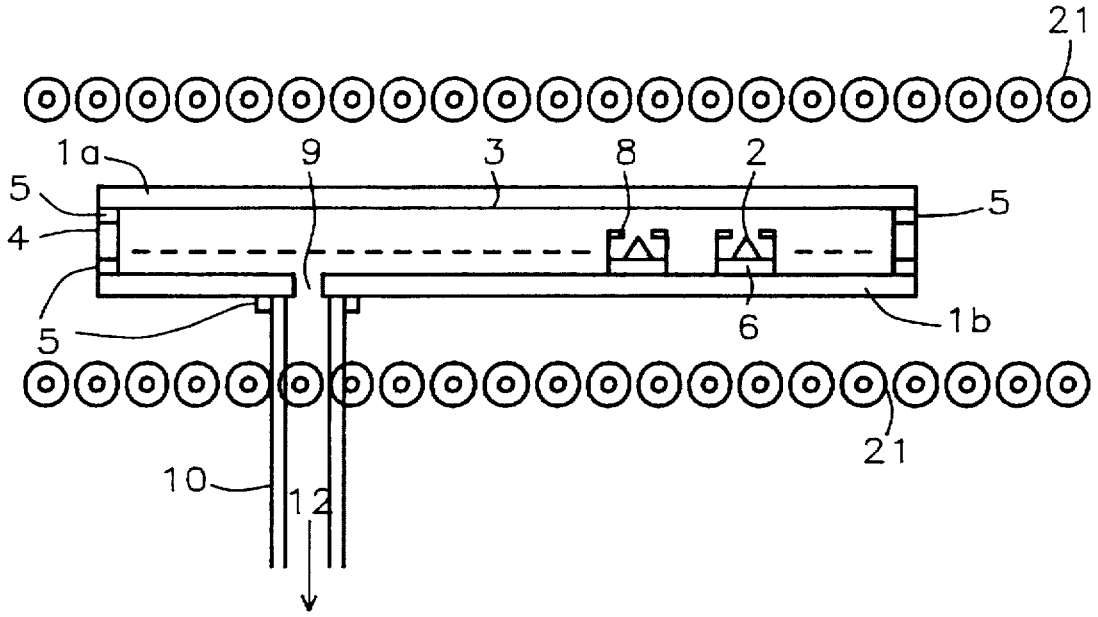
FIG. 1 – Prior Art
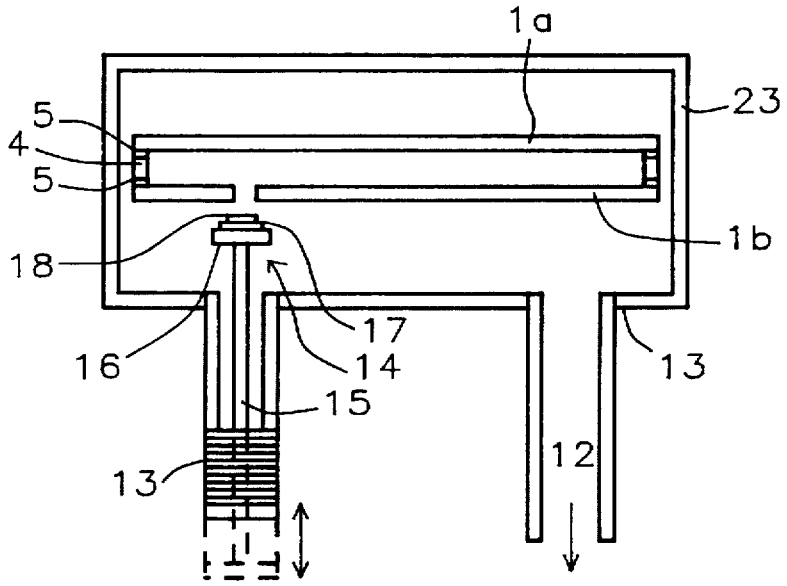
FIG. 2 – Prior Art

HYBRID TUBELESS SEALING PROCESS FOR FLAT PANEL DISPLAYS

TECHNICAL FIELD OF THE INVENTION

This invention describes an inexpensive, high throughput hybrid sealing process for fabrication and manufacturing of Field Emission Display Device (FED) and more particularly a method for achieving a high vacuum sealing with minimum contamination level and thereby prolongs the lifetime of display devices.

BACKGROUND OF THE INVENTION

This invention relates to manufacture of flat panel emission displays, (FEDs), more particularly, to the fabrication of the vacuum seal in the manufacturing of the field emission flat panel displays.

FED has, as well known, consists of an array of metal tips, such as tungsten or molybdenum or semiconductor, such as silicon or sapphire tips with radii of curvature less than 100 nm and an intertip spacing of a few micrometers. Electrons are emitted under vacuum from these microtips by applying a voltage between the cathode and gate, and accelerated toward the cathodo-luminescent phosphors anode which is placed at a pre-determined distance from the tip. The phosphors are patterned to define the pixel. Typically three different phosphors are deposited on the glass screen to achieve the three primary colors of red, green and blue. Alternatively, a white phosphor may be used to achieve the full color display. Isolation is achieved by the dielectric films. The dielectric film layer also served as selective etching or deposition mask in the fabrication process. The FED device is basically an array of microtip triodes housed between two glass plates. These glass plates are fused together with a peripheral glass frits seal. Glass spacers are placed to maintain the cathode-anode distance, and an exhaust tube to allow sealing by melting the glass exhaust tube after the vacuum is pumped to the desired pressure range, as in FIG. 1.

One of the failure modes of the FED device is the adsorption of gas on metals thereby changes their work functions. As much as 25 to 50% of changes were observed. Stable high vacuum in the glass panel FED device is essential for maintaining the work function of metals at its constant value. Another failure mode is caused by the ionization of residual gas which invariably leads to the generation of positive ions on the cathode tip, and causes subsequent defocusing of the electron spot on the phosphor. Therefore, the FED manufacturing industry is continually trying to improve the vacuum technology and sealing methods thereby, prolong the lifetime of these devices and simultaneously keep the cost of manufacturing to a minimum.

P. H. Holloway et al's publication in Solid State Technology Aug. '95 concluded that although FED offer many exciting potential, but currently many problems resulting from ceramic or glass/metal bonds remain to be solved before this technology become a reliable manufacturing product with long lifetime.

M. Albertin et al, U.S. Pat. No. 4,071,058, have described a two-stage pumping unit for evacuating television tubes. This pumping unit consists of an air-cooled mechanical pump which is connected in series with an oil diffusion pump. The method of sealing and maintaining a leak-free seal were not mentioned in their invention. M. Albertin et al's invention consists of the design of a vacuum pump unit for Cathode ray tubes in particular, the television tubes, which is entirely different from the Field Emission Display panel devices.

R. M. Boysel, U.S. Pat. No. 5,349,217 has described a method for producing a vacuum microelectronic device using the existing known semiconductor process technology, with multiple organic spacers, thus avoiding the residue and metal etching problems of fabricating an emitter, a grid and an anode on a semiconductor substrate. A metal seal is placed over the anode metal cover that closes off the apertures in the anode metal cover to maintain a vacuum beneath the metal seal, when the vacuum microelectronic device leaves the vacuum process chamber, 23, as shown in FIG. 2, which is a costly process and the residual gas from the large surface of the vacuum processing chamber often results in deterioration of the microtips. Again this invention does not address the problems specifically related to the Field Emission Display Panel Devices, described above.

R. Meyer's publication, Tech. Digest of IVMC '91 , Nagahama, pp. 6–9 showed a sketch of LETI's microtips display with a vacuum sealed exhaust tube. But there were no mention of the method for exhausting or/and sealing.

This invention will describe a hybrid tubeless sealing technique for flat panel display. This hybrid tubeless sealing method will overcome the poor vacuum resulted from sealing of the exhaust tube by melting of the glass tubing. It will also minimize the residual gases emitting from the melting of glass exhausting tube, i.e. less contamination on the phosphors and the metal tips, thereby improve the lifetime of the display device, without increasing the cost of manufacturing.

SUMMARY OF THE INVENTION

Accordingly, it is an object of this invention to provide a process for achieving high vacuum after sealing, to be used in fabrication of Field Emission Flat Panel Display devices.

It is another object of this invention to achieve high vacuum for sealing the FED without the use of high cost and low throughput vacuum oven or furnace.

It is another object of this invention to provide a high vacuum sealing process with vitreous glass frits thereby, minimizing /or eliminating the contamination of the phosphors and the cathode tips from the residual gases resulting from the melting of the exhaust tube glass.

It is another object of this invention to have the vitreous glass frits bound on a sealing plate by dispenser. This assembly is then placed on the end of a quartz plunger/holder. The vitreous glass frits/sealing plate is inserted into the aperture through the exhaust tube and sealed under high vacuum at temperatures ranging from 400 to 800 deg. C. The plunger/holder is then withdrawn from the glass plate/glass frits plug which is now the seal of the FED after cooling.

It is another object of this invention to separate the exhaust tube from the FED after the FED is sealed with the vitreous glass frits by cutting off the glass exhaust tube from the FED with a scriber or with a blade , after the high vacuum in the exhaust tube is returned to the atmospheric pressure at room temperature.

In accordance with the present invention, a hybrid sealing process is described for fabricating Field Emission Displays, in which a glass or metal plunger/holder holding a vitreous glass frits plug which is bound to a glass plate previously. This glass frits plug is then inserted through the exhaust tube and is placed into the aperture of the FED device under high vacuum. The vitreous glass frits forms a seal in the aperture of the FED glass plate at a oven temperature between about 400 to 500 deg. C. under high vacuum. The resulting seal in the exhaust tube is then cut off after the vacuum in the exhaust tube is returned to atmospheric pressure at room temperature , thereby, the exhaust tube is separated from the flat panel display device after the device has been sealed under high vacuum.

BRIEF DESCRIPTION OF THE DRAWINGS

The object and advantages of this invention are best described in the preferred embodiment by way of an example with reference to the accompanying drawings in which:

FIG. 1 shows the schematic cross-section of a flat panel FED device of the Prior Art sealed by melting the glass exhaust tube, the tube seal technique.

FIG. 2 shows the schematic cross-section of a flat panel FED device of the Prior Art sealed in a vacuum processing furnace chamber by vitreous glass frits.

DETAILED DESCRIPTION OF THE PREFERRED EMBODIMENT

The method of fabricating a flat panel FED type device with a high vacuum, low contamination seal by the hybrid tubeless technique will be described. The method described in this invention can be used for cost-effective manufacturing of any flat panel devices, such as FED, plasma display, or vacuum fluorescent display, CRT or any vacuum sealed devices where high vacuum maintenance is required.

Figure 3:
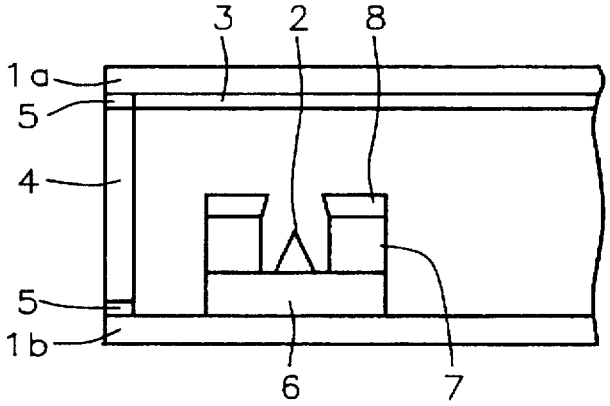
FIG. 3 shows a cross-section of a FED device
Figure 4:
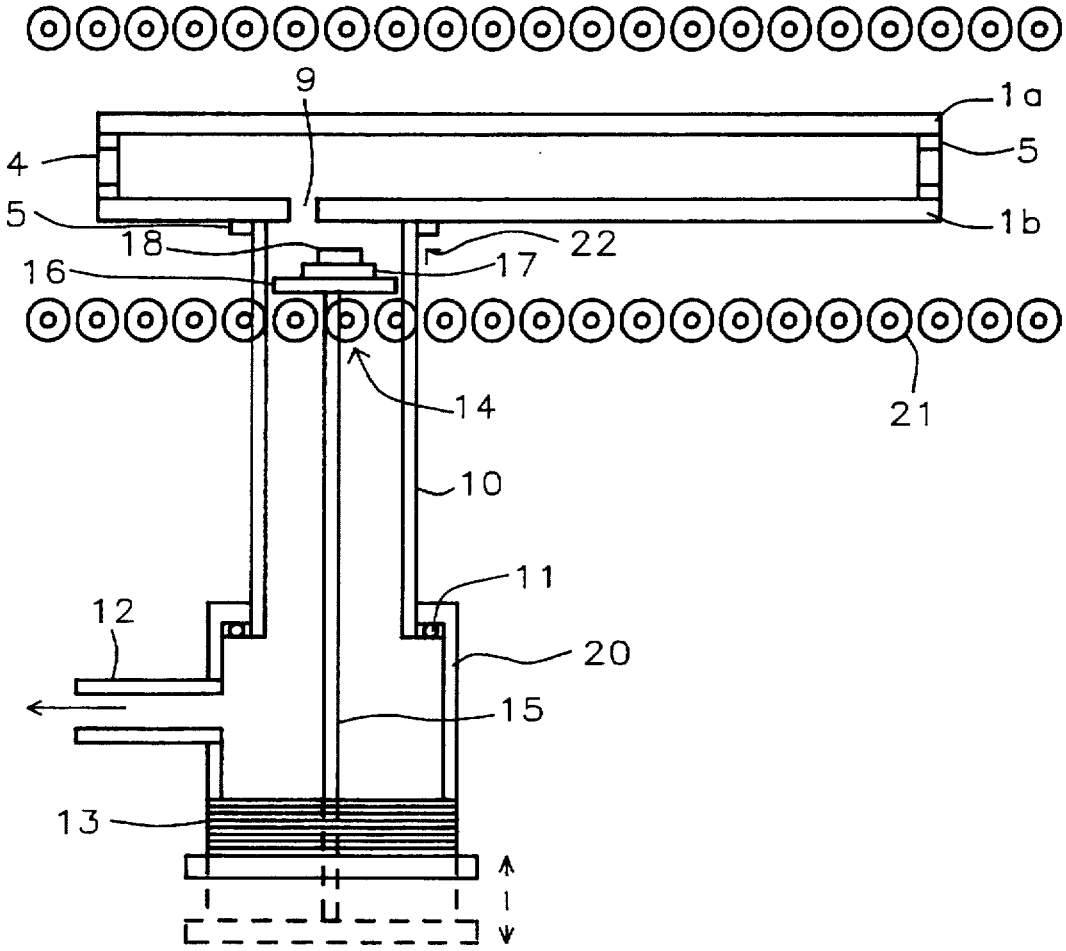
FIG. 4 shows schematically the cross-section of a flat panel FED device being sealed by the hybrid tube-less seal method of the invention.

FIG. 3 schematically shows a typical Micro-tip device that a low cost high vacuum seal will be applied to. The device is housed between 2 parallel pieces of flat panel glass, 1*a* & 1*b*. The front glass panel, 1*a*, and the back glass panel, 1*b*, are separated at a designated distance for the emitted electrons from the microtips, 2, to have maximum proximity focusing on the phosphors anode, 3. The two glass panels, 1*a* & 1*b*, and the spacing wall, 4, are sealed together with devitrified glass frits, 5. Typically, a metal substrate cathode, 6, supports an array of metal or semiconductor tips, 2, with radii of curvature of less than 100 nm. The substrate is covered with dielectric film layer, 7, the insulator. A patterned gate metal film, 8, is sputtered over the insulator, 7, using a sputtering system. The gate metal, 8, is patterned around the microtips, 2, at a distance between about 450 to 550 nm away from the microtip. The insulator layer, 7, is the inter-tip insulation as well as the insulator between the cathode, 6, and the gate metal, 8. Three different types of phosphors , 3, are deposited on the inside surface of the front glass panel, 1*a*, to achieve three primary colors. The two glass panels of FED device are assembled with a peripheral glass frits seal, 5, as shown in FIG. 4. The back flat glass panel, 1*b*, has an exhaust aperture , 9, of approximately between 4.5 to 5.5 mm in diameter. The aperture opens to a pumping system, via a glass exhaust tube, 10, which is connected to a three-port stainless steel tube, 12.

Figure 5:
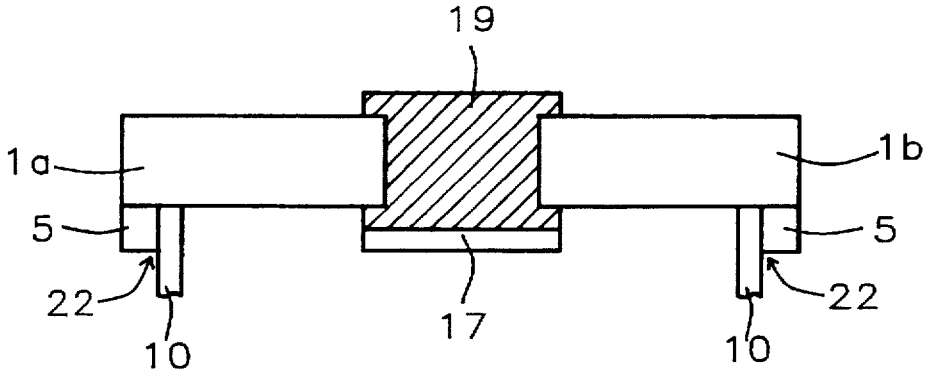
FIG. 5 shows the cross-section of the hybrid tubeless seal process after the vitreous glass frits have formed a spool-shaped plug in the aperture and over and under the aperture.

A hybrid sealing process will now be described by using a glass exhaust tube, 10, that is sealed to one end of a three-port stainless steel tube, 20, by a vacuum O-ring seal, 11. The branch tube, 12, of this three-port stainless steel connects to the pumping system, as shown in FIG. 4. The other end of this exhaust tube having a diameter approximately 7.0 to 13.0 mm larger than the exhaust aperture in the back flat glass is sealed to the back flat panel, 1*b*, around the aperture with de-vitrified glass frits,5. The aperture opening is centered in the aperture end of the exhaust tube. The other end of the straight portion of the three-port stainless steel tube is hermetically sealed with a linear motion feed-through mechanism, 13, which moves and manipulates a stainless or glass plunger, 14, as shown in FIG. 4. The plunger consists of a shaft, 15, with one end attached to the linear motion driving mechanism, 13, and the other end attached to a holder, 16. A sealing plate substrate, 17, having a diameter in the range, which overlaps the aperture opening, 9, by approximately 2.5 to 3.5 mm. The glass plate, 17, is adhered to the vitreous glass frits, 18, by dispenser. The vitreous glass frits having thickness in the range of about 0.75 to 1.25 mm, 18, has a diameter slightly smaller than the glass plate substrate. The sealing plate/vitreous glass frits assembly is then mounted onto the holder, 16, with only the glass plate, 17, held by of the plunger, i.e. the vitreous glass frits is at the front tip. It is important that the holder should only hold the sealing plate, and not in contact with the glass frits in order to minimize contamination. The sealing plate/vitreous glass frits assembly is driven toward the aperture and block the opening in the back flat panel after the pressure inside the panel box has reached a vacuum level of $5\times10^{-7}$ torr or lower at a temperature between about 400 to 500 deg.C. in the oven, 21. The thickness of the glass frits has to be pre-determined to allow the devitrified glass frits not only completely fill the aperture opening,9, in the glass panel to form a sealed plug, but also with overflow of the glass frits on both ends of the plug, thereby allowing overflown glass frits to bond to the inside and outside surfaces of the back glass panel, 1*b*, surrounding the plug as shown in FIG. 5, i.e. in the shape of a spool when the temperature of the glass frits reaches the oven temperature.

After the temperature of the seal is cooled , the spool shaped sealing plate/vitreous glass frits plug, 19, is then released from the holder, 16, of the plunger, with the spool shaped devitrified glass frits seal in the exhaust aperture, 9, of the back panel, 1*b*.

Figure 6:
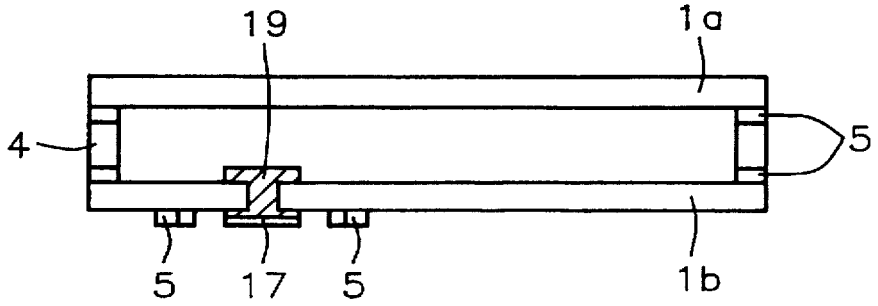
FIG. 6 shows the final cross-section of the hybrid tubeless seal process after the branched exhaust tube has been cut off.

The plunger with the holder is then withdrawn from the devitrified glass frits plug/sealing plate substrate assembly. A scribed line, 22, is made around outside circumference of the exhaust tube just away from the glass plate substrate and the exhaust tube is then break off from the device, or the exhaust tube is then cut off from the device by a mechanical saw, after the pressure in the exhaust tube has returned to atmospheric pressure as shown in FIG. 6.

It will therefore be seen that preferred embodiments of the present invention ensure numerous advantages:

Avoid the high cost of using a high vacuum oven.

Avoiding digesting from vacuum oven surface.

Minimizing contamination of the device components, such as the phosphor anodes, the microtips, etc. by the outgases resulting from sealing-off the exhaust tube by melting the glass wall of the exhaust tube.

High vacuum in the device is maintained because of elimination of residual gas contamination from melting of glass or/and from vacuum oven surface, etc..

Long lifetime of the device can be achieved due to the high level of vacuum achieved in the device.

Device can be processed in a high throughput conveyer, or batch type low cost furnace.

Although the method which has just been described may appear to be most advantageous in application to the generation of a high vacuum in the production and control of field emission flat panel display devices, it will be readily understood by those skilled in the art that various modifications can be made without going beyond the scope of this invention.

What is claimed is:

1. A method for sealing a FED device under high vacuum with a plug using a three-port hybrid tubeless technique, comprising the steps of:

providing a display device, which is encased in a glass panel casement having a front glass panel and a back glass panel with an exhaust aperture in one of the glass panel;

providing a straight glass exhaust tube;

attaching one end of said glass exhaust tube to the outer surface of said glass panel around said exhaust aperture;

providing a three-port stainless steel exhaust tube having an aperture-O-ring port, a hermetically sealed port and a pumping port, wherein the aperture-O-ring port and the hermetically sealed port are at opposite ends of said stainless steel exhaust tube;

attaching the aperture-O-ring port end of said stainless steel exhaust tube to the unattached end of the glass exhaust tube with the O-ring vacuum seal;

connecting a pumping system to the pumping port of the stainless steel exhaust tube;

connecting a linear feedthrough mechanism to allow linear movement through the hermetically sealed port;

placing a vitreous glass frits disk on a flat sealing plate substrate to form a sealing assembly;

placing said sealing assembly in a holder locating at the inserting end of a retractable plunger;

inserting the retractable plunger with the sealing assembly mounted in the holder into the stainless steel exhaust tube through the hermetically sealed port and through the attached glass exhaust tube, with the glass frits facing the aperture of said panel;

attaching the shaft end of said retractable plunger inside the exhaust tube to the linear motion feedthrough mechanism at the hermetically sealed end of the exhaust tube;

inserting said display device having the aperture end of the stainless steel exhaust tube connected to the back panel of the device around the aperture via a glass tube, into a heated oven/furnace;

pushing the glass frits sealing plate substrate assembly held by the plunger using the linear feedthrough mechanism until the surface of the glass frits disk is firmly pressed against the aperture of said panel in the oven, when the high vacuum is achieved inside the display device releasing the vitreous glass frits/ sealing plate substrate assembly from the holder when the vitrify glass frits disk forms a plug in the aperture and seals the display device under high vacuum;

moving the plunger away from the glass frits plug/glass plate substrate seal in the display device panel, after temperature has cooled down shutting off the vacuum pumping system, wherein the plunger with holder is withdrawn by the linear motion feedthrough mechanism into the section of the exhaust tube left outside of the oven;

removing the sealed display device from the oven; and cutting off the exhaust tube from the display device.

2. The method of claim 1 wherein the glass panel thickness is in excess of the cracking threshold resulted from the differential of pressure between atmospheric and vacuum pressures.

3. The method of claim 1 wherein the diameter of the aperture port of the exhaust tube is larger than the exhaust aperture in the panel.

4. The method of claim 1 wherein the aperture end of the exhaust tube is attached to the glass panel around the exhaust aperture, with the aperture located in the center of the exhaust tube.

5. The method of claim 1 wherein the retractable plunger is made of glass.

6. The method of claim 1 wherein the retractable plunger is made of metal.

7. The method of claim 1 wherein the shaft of the retractable plunger is attached to said linear motion feedthrough mechanism inside the exhaust tube.

8. The method of claim 1 wherein the vitreous glass frits is bonded to the top surface of the sealing plate substrate in a furnace/oven in air ambient and at a temperature between about 450 to 600 deg. C.

9. The method of claim 1 wherein the sealing assembly is mounted onto the holder of said plunger, with the free surface of the glass plate substrate held by the holder.

10. The method of claim 1 wherein the free surface of the vitreous glass frits faces the aperture of the glass panel.

11. The method of claim 1 wherein the center of the glass frits is aligned to the center of the exhaust aperture.

12. The method of claim 1 further comprising inserting said FED device with the attached aperture end of the exhaust tube, into a conveyer oven, wherein said conveyer oven is maintained at a temperature between about 450 to 600 deg. C.

13. The method of claim 1 further comprising of pushing the plunger with the vitreous glass frits sealing plate substrate assembly in the holder against the exhaust aperture of the display panel when the vacuum pressure inside the device is equal or less than about $5\times10^{-7}$ torr.

14. The method of claim 1 further comprising releasing the sealing assembly from the holder when the vitreous glass frits forms a spool-shape plug sealing of the said display device after the temperature has cooled down.

15. The method of claim 1, wherein the exhaust tube is broken off from the display device's sealed aperture by scribing a line around the outer circumference of the exhaust tube, a distance away from the glass frits plug's glass substrate.

16. The method of claim 15, wherein said exhaust tube is severed from the display device by a tap at the scribed line leaving the glass substrate and the glass frits plug untouched.

17. The method of claim 1, wherein the exhaust tube is cut from the display device with a blade a distance away from the said sealed plug/glass plate substrate.

18. A method for sealing a FED device under high vacuum with a spool-shaped plug, comprising the steps of:

providing a display device which is encased in a glass panel casement having a front glass panel and a back glass panel with an exhaust aperture in the back glass panel, wherein the thickness of these glass panels is in excess of cracking threshold resulted from the differential of pressure between atmospheric and vacuum pressures;

providing a straight glass exhaust tube;

attaching one end of said glass exhaust tube to the outer surface of said glass panel around said exhaust aperture;

providing a 3-port stainless steel exhaust tube having an aperture-O-ring port, a hermetically sealed port and a pumping port, wherein the aperture-O-ring port and the hermetically sealed port are at opposite ends of the stainless steel exhaust tube;

attaching the aperture-O-ring port end of said exhaust tube to the unattached end of the glass exhaust tube with the O-ring vacuum seal;

connecting a pumping system to the pumping port of the stainless steel exhaust tube;

connecting a linear feed through mechanism to allow linear movement through the hermatically sealed port;

placing a vitreous glass frits having a diameter between 1.5 and 2.5 mm larger than the exhaust aperture, and having a thickness of 1.5 to 2.5 times the thickness of the back glass panel to insure an overflow of vitrified glass from the aperture to form a spool shaped glass plug in and over the exhaust aperture, on a flat glass plate substrate having a diameter of 7 to 9 mm, larger than the glass frits disk;

fusing the contacting surfaces of the glass frits disk and the glass plate substrate in a furnace/oven mounting the flat sealing plate substrate with the fused glass frits disk in a holder locating at the inserting end of a retractable plunger;

inserting said plunger with the vitrify glass frits disk/flat sealing plate substrate mounted in the holder into the exhaust tube through the hermetically sealed port, having the glass frits disk facing the exhaust aperture of the back panel;

attaching the shaft end of said retractable plunger inside the exhaust tube to a linear motion feedthrough mechanism at the hermetically sealed port of said exhaust tube;

sealing off the hermetically sealed port of said exhaust tube, with linear feedthrough manipulation of the plunger outside the hermetically sealed end of the exhaust tube;

inserting said display device having the exhaust aperture connected to the aperture end of the glass exhaust tube into a heated oven/furnace, leaving the remainder portion of the exhaust tube and the stainless steel three-port exhaust tube outside the oven;

pushing the glass frits disk/plate glass plate assembly held in the plunger, against the exhaust aperture of the back panel of said device using the linear feedthrough mechanism, when the desired vacuum of equal or less than $5\times10^{-7}$ torr is established.

releasing the vitreous glass frits Iflat sealing plate substrate assembly from the holder when the vitreous glass frits forms a spool shaped plug in the exhaust aperture and sealed the display device in the heated oven/furnace under said high vacuum;

retrieving the plunger away from the spool shaped glass frits plug/flat glass plate substrate assembly in the back panel of the device, into the unheated portion of the exhaust tube outside of the heated oven;

shutting off the vacuum pump system;

removing the sealed display device from the oven; and cutting off the exhaust tube from the display device.

19. The method of claim 18 wherein the diameter of the aperture port of the exhaust tube is about 7 to 13 mm larger than the back panel exhaust aperture of about 4.5 to 5.5 mm.

20. The method of claim 18 wherein the aperture end of the glass exhaust tube is attached to the glass panel around the exhaust aperture, with the center of the aperture aligned to the center of the aperture port of the exhaust tube.

21. The method of claim 18 wherein the other end of the glass exhaust tube is attached to the aperture-O-ring port of the three-port stainless steel exhaust tube.

22. The method of claim 18 wherein the side tube, the pumping port of said stainless steel exhaust tube is attached to a high vacuum pumping system.

23. The method of claim 18 wherein the hermetically seal port of said stainless steel exhaust tube is hermetically fitted with a stainless steel linear motion feedthrough mechanism for manipulating the plunger inside the exhaust tube from outside of the hermetically sealed port.

24. The method of claim 18 wherein the plunger is made of glass.

25. The method of claim 18 wherein the plunger is made of stainless steel.

26. The method of claim 18 wherein the shaft of the plunger is attached to said linear motion feedthrough mechanism inside the exhaust tube.

27. The method of claim 18 wherein the vitreous glass frits is of 5 to 7 mm in diameter and of 0.75 to 1.25 mm in thickness, and the sealing plate substrate is 6.5 to 9.5 mm in diameter.

28. The method of claim 18 wherein one surface of the vitreous glass frits disk is bonded to the top surface of the glass sealing plate substrate in a furnace/oven in air ambient and at a temperature between 450 and 650 deg. C.

29. The method of claim 18 wherein one surface of the vitreous glass frits disk is adhered to the top surface of the glass sealing plate substrate by heating.

30. The method of claim 18 wherein the bonded vitreous glass frits/ sealing plate substrate assembly is mounted onto the holder of said plunger, with the free surface of the glass plate substrate held by the holder.

31. The method of claim 18 wherein the free surface of the vitreous glass frits disk faces the aperture of the glass panel.

32. The method of claim 18 wherein the center of the glass frits disk is aligned to the center of the exhaust aperture.

33. The method of claim 18 further comprises of inserting said FED device with the attached aperture end of the glass exhaust tube., into a conveyer oven, wherein said conveyer oven is maintaining at a temperature between about 450 to 600 deg. C.

34. The method of claim 18 further comprises of pushing the plunger with the vitreous glass frits sealing plate substrate assembly in the holder against the exhaust aperture of the display panel into the heat zone of the oven when the vacuum pressure inside the device is equal or less than $5\times10^{-7}$ torr.

35. The method of claim 18, wherein the plunger with holder is withdrawn by the linear motion feedthrough mechanism into the cooler section of the exhaust tube left outside of the oven, wherein the temperature is between about 75 to 100 deg. C.

* * * * *